United States Patent [19]

Audeh

[11] 4,424,120

[45] Jan. 3, 1984

[54] PROCESS FOR REMOVAL OF ALKYL LEAD IMPURITIES FROM LIQUID HYDROCARBONS

[75] Inventor: Costandi A. Audeh, Princeton, N.J.

[73] Assignee: Mobil Oil Corporation, New York, N.Y.

[21] Appl. No.: 118,815

[22] Filed: Feb. 5, 1980

Related U.S. Application Data

[63] Continuation-in-part of Ser. No. 754,461, Dec. 27, 1976, abandoned.

[51] Int. Cl.[3] ..... C10G 29/04

[52] U.S. Cl. ..... 208/253; 208/262

[58] Field of Search ..... 208/253, 262

[56] References Cited

U.S. PATENT DOCUMENTS

| | | | |
|---|---|---|---|
| 2,368,261 | 1/1945 | Neef | 208/252 |
| 2,504,134 | 4/1950 | Kharasch . | |
| 2,745,793 | 5/1956 | Jezl et al. . | |
| 3,082,166 | 3/1963 | Skarstrom | 208/299 |
| 3,481,866 | 12/1969 | Moss et al. | 208/251 R |
| 3,893,912 | 7/1975 | Zimmerman | 208/253 |
| 3,919,077 | 11/1975 | Whitehurst | 208/253 |
| 3,935,295 | 1/1976 | La Hue et al. | 208/262 |
| 3,998,725 | 12/1976 | Zimmerman . | |
| 4,125,457 | 11/1978 | Brennan et al. | 208/299 |
| 4,136,021 | 1/1979 | Whitehurst | 208/253 |

*Primary Examiner*—Charles F. Warren
*Assistant Examiner*—Joseph A. Boska
*Attorney, Agent, or Firm*—Alexander J. McKillop; Michael G. Gilman; Howard M. Flournoy

[57] ABSTRACT

Lead impurities are removed from liquid hydrocarbons by contacting them with a solid sorbent having anhydrous HCl adsorbed therein.

24 Claims, No Drawings

PROCESS FOR REMOVAL OF ALKYL LEAD IMPURITIES FROM LIQUID HYDROCARBONS

CROSS-REFERENCES TO RELATED APPLICATIONS

This is a continuation-in-part of Ser. No. 754,461 filed Dec. 27, 1976, now abandoned.

BACKGROUND OF THE INVENTION

1. Field of the Invention

This application is directed to a process for the removal of alkyl lead impurities from liquid hydrocarbons.

2. Description of the Prior Art

Lead and its compounds, especially alkyl lead, $R_4Pb$, are not recognized as naturally occurring in crude oil. However, lead is found in crude oils and their distillate fractions and is usually traced to the lead contamination in gasoline.

It is known to use cupric chloride impregnated on nongraphitic carbon or on silica gel for removing lead contamination from unleaded gasoline; A. A. Zimmerman, G. S. Musser et al., SAE Fuels and Lubricants Meeting. (Houston 6/3-5/75) Technical Paper; Chemical Abstracts vol. 85-1976, 49026 G. It is also known to remove lead from motor fuels for internal combustion engines by contacting the fuel with a strongly acidic cation exchanger (German Pat. DT No. 2,361,025); and to remove dissolved organic lead compounds from various liquid hydrocarbons by pretreatment with $SiCl_4$, $CuCl_2$, $CuBr_2$, $I_2$ or $I_2$ combined with an acid followed by contacting the pretreated hydrocarbon with activated carbon and an acid treated clay or silica gel (U.S. Pat. No. 3,893,912).

However, significant amounts of lead impurities remain after such treatments and additional lead contamination may be acquired in shipping, for example, when a naphtha reformer feed is purchased in one location and shipped to another for reforming.

For example, U.S. Pat. No. 2,368,261 (Neef) discloses the use of acid activated sorbents to remove lead contaminants from gasoline. The process of Neef, however, utilizes aqueous sorbents and large amounts of lead, as much as 0.20 gm per gallon, remain after the treatment. The instant process is directed to a process utilizing anhydrous sorbents which reduce lead levels to less than 0.20 gm per 16,000 gallons of gasoline treated.

SUMMARY OF THE INVENTION

Therefore, this application is directed to a novel process wherein substantially all of the lead contaminants contained in a given liquid hydrocarbon solution are removed. For example, feedstocks to reformer units in refineries should be substantially free of lead impurities to guarantee reasonable economics of operation. Contamination of reformer feedstock by lead impurities put the reformer facilities out of balance and cause unnecessary reformer catalyst poisoning. By means of the process disclosed herein lead contamination in for example naptha reformer feedstocks of 75 parts per million (ppm) is reduced to less than 5 parts per billion (ppb).

Accordingly, this application is more particularly directed to a process for effecting the removal of alkyl lead contaminant from liquid hydrocarbon media containing said contaminant which comprises contacting said hydrocarbon at a temperature below the boiling point thereof with a solid sorbent having an amount of anhydrous HCl gas adsorbed therein sufficient to effect substantial reduction in the concentration of said contaminant and maintaining said contact until substantially all of said contaminants are removed therefrom.

DESCRIPTION OF SPECIFIC EMBODIMENTS

The novel process in accordance with the invention disclosed herein is generally useful for removing alkyl lead impurities from any liquid hydrocarbon media. It is suitable for treating petroleum oils of lubricating viscosity, distillate fuel oils, gasoline and similar light liquid hydrocarbon products including both mineral oil and synthetic hydrocarbon products. The preferred embodiment is the removal of lead contamination from reformer feeds.

A wide variety of solid sorbents may be advantageously used. These sorbents (supports) can be crystalline or amorphous. Amorphous sorbents, however, have proven to be more advantageous. In any event, the sorbents must have sufficient surface area and porosity to adsorb an effective amount of the anhydrous HCl. The surface area of the sorbents useful herein is from about 5 $m^2/g$ to about 1000 $m^2/g$; the surface area of zeolite crystalline sorbents is usually from about 100 to about 1000 $m^2/g$ and preferentially from 100 to about 750 $m^2/g$; the surface area of the amorphous sorbents is usually from about 5 to about 750 $m^2/g$ and preferably from about 150-600 $m^2/g$. The average pore diameter of the sorbent should be from about 3 to about 200 Å; the average pore diameter of zeolite crystalline sorbents used herein is usually less than about 10 Å, i.e., from about 3-9 Å; of amorphous sorbents it is usually from about 10-20 to about 200 Å and preferentially from about 20-100 Å.

Suitable sorbents include synthetic or naturally occurring materials such as faujasite (zeolite X, zeolite Y), mordenite, and various other zeolites as may be suitable, e.g., zeolite ZK-4, zeolite ZSM-5, as well as such inorganic materials as bauxite, clay, silica and/or metal oxides and naturally occurring clays which can be composited with the zeolites, these include the montmorillonite and kaolin families, which include the sub-bentonites and the kaolins commonly known as Dixie, McNamme-Georgia and Florida clays or others in which the main mineral constituent is halloyxite, kaolinite, dickite, nacrite or anauxite and activated carbons. Such clays can be used in the raw state as originally mined or initially subject to calcination, acid treatment or chemical modification.

In addition to the foregoing materials, zeolites employed herein may also be composited with material such as bauxite, alumina, silica-alumina, silica-magnesia, silica-zirconia, silica-thoria, silica, berylia, silica-titania as well as ternary compositions, such as silica-alumina-thoria, silica-alumina, zirconia, silica,-alumina-magnesia and silica-magnesia-zirconia. Preferred are sorbents selected from the group consisting of various forms of silica, bauxite, mordenite, faujasite, natural and synthetic clays, amorphous and crystalline alumino-silicates, alumina and silica-alumina mixtures; silica-alumina mixtures may contain about 5 to 95% silica or preferably about 5-25 wt. % or about 75-95 wt. % silica to alumina. Thermofor cracking catalysts (TCC) such as fresh, spent or regenerated bead type TCC catalysts may be used herein as sorbents.

The effective amount of adsorbed anhydrous HCl gas will vary dependent upon type of sorbent, adsorption conditions of temperature and pressure as well as reaction parameters. Usually the sorbent disclosed herein will contain from about 0.001 to about 20 wt. % of adsorbed HCl and preferably from about 0.1 to about 17.5 wt. % based on the total weight of the sorbent.

The process of removing lead contaminants, e.g., tetraethyl or tetramethyl lead, from liquid hydrocarbons is conveniently carried out in a simple flow or batch process. A solution of the lead contaminated hydrocarbon is passed over the sorbent, e.g., NaX-zeolite, amorphous silica, etc., lead compounds in the solution undergo a displacement reaction giving an insoluble alkyl salt, i.e., $R_3PbCl$ and a gaseous product, i.e., RH. The gas escapes through the solution and the insoluble salt remains on the sorbent. The process is carried out at room temperature or at any temperature below the boiling point of the liquid hydrocarbons. Preferred operating conditions are a temperature of from about 25°-60° C., LHSV of from about 5-20 and atmospheric or slightly higher pressure. A suitable sorbent, i.e., silica, alumina, mixtures thereof and calcined X and Y zeolites such as calcined NaX, may be included after the lead removal step to remove (i.e., adsorb) any HCl desorbed during the lead removal stage of the process. For a "wet" (having more than about 100 ppm water) hydrocarbon feed, a drying step utilizing the above operating conditions and also utilizing calcined NaX or other suitable dessicant can precede the lead removal step e.g., commercial drying agents comprised of silica, alumina, mixtures thereof, and X and Y zeolites are suitable.

EXAMPLE 1

100 grams NaX 1/16" extrudate were calcined in a glass reactor at 350° C. in argon for about 16 hours and cooled at room temperature. A stream of anhydrous hydrogen chloride gas was allowed to contact the zeolite (pore diameter about 7-9 Å; surface area about 750 $m^2/g$), downflow until the loading was complete, i.e., about 15.6-17.5 wt. % of HCl at equilibrium at room temperature. When anhydrous HCl contacts the sorbent, an exothermic reaction zone develops at the top of the reactor. This zone moves down the bed. After the bottom section of the reactor cooled down, in an atmosphere of HCl gas, the reactor was purged with dry argon for about 1 minute to remove any easily-desorbed HCl.

EXAMPLE 2

80 grams of a NaX molecular sieve, 1/16" extrudate, were placed in a glass reactor, calcined at 400° C. in argon for about 16 hours and cooled to room temperature. Anhydrous HCl gas was then passed downflow (as in Example 1) over the calcined sorbent until HCl loading was complete; the NaX extrudate adsorbed about 12.5 g HCl, or about 15.6 wt. % and was otherwise prepared in the manner of Example 1.

EXAMPLE 3

32.1 grams of a commercially obtained amorphous silica-alumina sorbent (Durabead-1) having the following general properties: pore diameter about 80 Å; surface area about 200 $m^2/g$. and a silica to alumina ratio of about 9:1, were calcined in argon at 350° C. for about 16 hours and cooled to room temperature. Dry HCl gas was then passed downflow over the catalyst until equilibrium at room temperature was reached. 0.345 grams of HCl ($\approx$1% wt.) were adsorbed by the sorbent.

EXAMPLE 4

A regular gasoline containing 1.8 g/gal Pb was used as a 10% contaminant in a Pb-free naphtha reformer feed. A suitable reactor containing the NaX sorbent with adsorbed anhydrous HCl as described in Example 1 was connected to a feed pump. Naphtha was introduced at the bottom of the reactor at 0.6 LHSV and at a temperature of about 5° C. below the boiling point of the naphtha by means of a metering pump and moves upflow through the bed until it reaches the exit at the top of the reactor. The naphtha is then collected as product. Reformer naphtha properties are as shown in Table 1, <5 ppb lead before contamination and 75,000 ppb after contamination. Product naphtha properties are shown in Table 2, after treatment with the sorbent of Example 2 lead contamination was reduced to <5.

TABLE 1

PROPERTIES OF NAPHTHA FEED

| | Fresh Naphtha | Contaminated with 10% Regular Gasoline |
|---|---|---|
| Gravity, °API | 63.0 | 62.2 |
| Vapor Pressure | 2.3 | 3.3 |
| Water, ppm. | 44 | — |
| Lead, ppb. | <5 | 75,000 (75 ppm) |
| Chloride, $Cl^-$ | absent | absent |
| Distillation, °F. | | |
| 5% | 188 | — |
| 10% | 198 | — |
| 30% | 215 | — |
| 50% | 237 | — |
| 70% | 264 | — |
| 90% | 296 | — |
| EP | 335 | — |

TABLE 2

Properties of Naphtha Treated With HCl/NaX, 0.6 LHSV, 10 vol/vol of Contact Mass

| | 25° C. | 90° C. |
|---|---|---|
| Gravity, °API | 62.2 | — |
| Lead, ppb. | <5 | <5 |
| Chloride, $Cl^-$ | absent | absent |

EXAMPLE 5

One gallon of a hexane/toluene mixture (70/30 vol.) containing 174 ppm Pb was pumped upflow, 0.5 LHSV and at room temperature, through a sorbent system as described in Example 3 followed by another gallon containing 340 ppm lead. Finally, 1500 ml containing 450 ppm lead were used. 10 ml samples of product were taken for diagnostic Pb analyses by Test Method A (described below) at 24 hour intervals. In addition, 500 ml samples were taken at about 25%, 65%, and 75% HCl depletion points for ppb Pb analyses by Test Method B (described below). Table 3 summarizes data obtained on samples of Pb-contaminated light hydrocarbon mixtures treated with the silica-alumina/HCl sorbent system of Example 3 at room temperature.

Data in Table 3 show that the stoichiometry of the reaction is one mole of HCl to one mole of $R_4Pb$. Thus, for the amount of HCl adsorbed, 0.345 gm. (9.45 mmols), a maximum of 1.958 gm. of Pb would be expected to react, $$R_4Pb + HCl \rightarrow RH + R_3PbCl$$

where $R_4Pb$ is a commercial mixture of tetraalkyl lead; i.e., tetraethyl, tetramethyl, trimethylethyl, diethyldimethyl etc.

Table 3 further shows that at 99.2% of HCl used, the contact mass reduces 450 ppm Pb in the feed to 38 ppm and at a point ≈100% to >300 ppm and that alkyl lead compounds react with available HCl in the catalysts until all the HCl is depleted.

TABLE 3

REMOVAL OF $R_4Pb$ FROM LEAD CONTAMINATED[1] LIQUID HYDROCARBONS[2] BY TREATMENT WITH HCl/SILICA-ALUMINA AT 25° AND 0.5 LHSV

Sorbent: Example 3

| Pb, ppm in Feed (g/gal) | Pb, gm Removed by Contact Mass | Pb in Treated Naphtha ppb[a] | Pb in Treated Naphtha ppm[b] | % of Adsorbed HCl Used |
|---|---|---|---|---|
| 174 (0.49) | 0.41 | | <0.1 | — |
| | 0.45–0.48 | <5 | <0.1 | 25 |
| 340 (0.98) | 0.76 | — | <0.1 | 38 |
| | 0.91 | — | <0.1 | 46 |
| | 0.13 | — | <0.1 | 58 |
| | 1.16–1.30 | <5 | <0.1 | 59–67 |
| | 1.30 | — | <0.1 | 67 |
| | 1.30–1.43 | 29 | <0.1 | 67–73 |
| | 1.46 | — | 0.4 | 75 |
| 450 (1.26) | 1.46–1.93 | — | 4.1 | 75–99 |
| | 1.93 | — | 32 | 99 |
| | 1.94 | — | 38 | 99.2 |
| | >1.96 | — | >300 | ≈100 |

[1]A commercially available mixture of tetraalkyl leads, i.e., tetramethyl, tetraethyl, trimethyl-ethyl, diethyl-di-methyl etc., was used as the contaminant.
[2]Moisture content <100 ppm.
[a]Test Method A
[b]Test Method B (ASTM D3237).

Test Method A is used to determine lead in reformer naphthas and similar light hydrocarbon stocks at concentrations below 100 ppb, i.e., trace amounts of lead. Lead present as alkyllead contamination and as naphthenates and other compounds decomposed by bromine are determined. Other metals do not interfere.

OUTLINE OF METHOD A

A 500-ml sample is reacted in an appropriate sample bottle with 454 g (5 N) bromine diluted in carbon tetrachloride to 1 liter, for 2 minutes at room temperature, and then extracted with water. The extract is transferred to a test tube and aspirated into the burner of an atomic absorption spectrometer. The absorbance of the 2170 Å line is measured and converted to lead content by means of a calibration curve.

Test Method B (ASTM D3237) is used to analyze unleaded materials such as fuels containing 0.5 ppm or more of lead.

OUTLINE OF METHOD B

The atomic absorption spectrophotometer is adjusted with the aid of commercially obtained standardization solutions. The sample material is then aspirated directly into the instrument and the absorption is measured.

As is readily apparent from the data in the foregoing Tables, the sorbent system and method of use thereof is a significant improvement in the art.

TABLE 4

REMOVAL OF $R_4Pb$ FROM KUWAIT LEAD[1] CONTAMINATED NAPHTHA BY TREATMENT WITH 10 ML. HCl/SILICA-ALUMINA AT 25° C.

Sorbent: Example 3

| Catalyst Pb in Feed ppb | Cumulative Vo. Ml. | LHSV hr 1 at 25° C. | Pb in Treated Naphtha, ppb |
|---|---|---|---|
| 88 | 600 | 5 | <5 |
| | 1200 | 10 | <5 |
| | 1700 | 15 | <5 |
| | 2200 | 20 | <5 |

[1]See Table 3 for Pb contaminant used.

TABLE 5

REMOVAL OF $R_4Pb$ FROM KUWAIT LEAD[1] CONTAMINATED NAPHTHA BY TREATMENT WITH 10 ML. HCl/SILICA-ALUMINA AT 20.5 LHSV

Sorbent: Example 3

| Catalyst Pb in Feed ppb | Cumulative Vol. Ml. | Temperature °C. at 20.5 LHSV | Pb in Treated Naphtha, ppb |
|---|---|---|---|
| 88 | 2700 | 26 | <5 |
| | 3200 | 45 | <5 |
| | 3700 | 60 | <5 |

[1]See Table 3 for Pb contaminant used.

EXAMPLE 6

Samples of naphtha (see Table 1) were contaminated by the addition of about 0.2 ml of 5 g Pb/gal. gasoline to 1 gallon of Kuwait naphtha to give 88 ppb of lead contamination; and processed as described above using the sorbent of Example 3; see Tables 4 and 5.

The data in Tables 4 and 5 illustrate that reformer feeds containing as little as 88 ppb contamination can be even further reduced to safe reformer levels, i.e., <5 ppb by the process of this invention.

In a direct comparison under identical test conditions an anhydrous HCl treated sorbent in accordance with the present invention and an aqueous HCl treated sorbent (such as disclosed by the prior art) were evaluated for their ability to remove alkyl lead impurities from a liquid hydrocarbon medium. The test medium was a naphtha feed equivalent prepared as in Example 5; the anhydrous HCl treated sorbent was prepared as in Example 3; and the aqueous HCl treated sorbent was prepared by contacting under appropriate conditions an aliquot of the same sorbent used in Example 3, prior to treatment with anhydrous HCl, with an aqueous solution of HCl until 1% wt. HCl was adsorbed thereon and thereafter the sorbent was dried at 100° C., the boiling point of water. It is noted that such a post treatment temperature is accordingly reasonable in view of prior art "acid activation" treatments. The results set forth in Tables 6 and 7 make it obvious to those of ordinary skill in the art that the instant process wherein anhydrous HCl treated sorbents are used is surprisingly highly superior to aqueous HCl treated sorbents as disclosed by prior art. Thus it is also quite clear that such prior art treatment techniques cannot reduce lead from low levels to much lower levels. The aqueous HCl treated sorbent as disclosed by Table 6 removes only about 40% of the lead contaminant whereas the anhydrous HCl treated sorbent of the present invention removes better than 99.9% of the lead contaminant.

Although preferred embodiments have been exemplified, variations can be resorted to and are within the scope of this invention as one of ordinary skill in the art will readily understand.

TABLE 6

REMOVAL OF $R_4Pb$ FROM LEAD CONTAMINATED[1] LIQUID HYDROCARBONS[2] BY TREATMENT WITH HCl/SILICA-ALUMINA AT 25° AND 0.5 LHSV

Sorbent: Example 3

| Pb, ppm in Feed (g/gal) | | Pb, gm Removed by Contact Mass | | Pb in Treated Naphtha[c] | | |
|---|---|---|---|---|---|---|
| Anhydrous HCl | Aqueous HCl | Anhydrous | Aqueous | Anhydrous ppb[a] | Anhydrous ppm[b] | Aqueous ppm[b] |
| 174 (0.49) | 174 (0.49) | 0.41 | 0.01 | | <0.1 | 77 |
| | | 0.45–0.48 | | <5 | <0.1 | |

[1]A commercially available mixture of tetraalkyl leads, i.e., tetramethyl, tetraethyl, trimethyl-ethyl, diethyl-dimethyl etc., was used as the contaminant.
[2]Moisture content <100 ppm.
[a]Test Method A; see page 12 of specification.
[b]Test Method B (ASTM D3237); see page 12 of specification.
[c]Example 5, page 10 of specification.

TABLE 7

REMOVAL OF $R_4Pb$ FROM KUWAIT LEAD[1] CONTAMINATED NAPHTHA BY TREATMENT WITH 10 ML. HCl/SILICA-ALUMINA AT 25° C.

Sorbent: Example 3

| Catalyst Pb in Feed ppb | | Cumulative Vo. Ml. | | LHSV $hr^{-1}$ at 25° C. | | Pb in Treated Naphtha, ppb | |
|---|---|---|---|---|---|---|---|
| Anhydrous HCl | Aqueous HCl | Anhydrous | Aqueous | Anhydrous | Aqueous | Anhydrous | Aqueous |
| | | | 100 | | 5 | | |
| 88 | 88 | 600 | 300 | 5 | 5 | <5 | 35 |
| | | | 900 | | 10 | | 70 |
| | | 1200 | 1200 | 10 | 10 | <5 | 86 |
| | | | | | | | 88 |

[1]See Table 1 for Pb contaminant used.

What is claimed is:

1. A process for effecting the removal of alkyl lead contaminant from liquid hydrocarbon media containing said contaminant which comprises contact of said hydrocarbon media at a temperature below the boiling point thereof with a solid sorbent having an amount of anhydrous HCl gas adsorbed therein sufficient to effect substantial reduction in the concentration of said contaminant and maintaining said contact until substantially all of said contaminant is removed therefrom.

2. The process of claim 1 wherein the initial amount of HCl adsorbed is from about 0.001 wt. % to about 20 wt. % based on the total weight of the sorbent.

3. The process of claim 2 where the sorbent has an average pore diameter of from about 3 to about 200 Å and an average surface area of from about 5 to about 1000 $m^2/g$.

4. The process of claim 1 wherein said sorbent is selected from the group consisting of various forms of silica, bauxite, mordenite, faujasite, natural and synthetic clays, amorphous and crystalline aluminosilicates, alumina, and silica-alumina mixtures.

5. The process of claim 4 where said sorbent is amorphous silica-alumina.

6. The process of claim 4 where said sorbent is an amorphous silica-alumina, silica-clay, or other gel-type matrix containing a minor proportion of crystalline aluminosilicate zeolite.

7. Process of claim 6 where said crystalline aluminocilicate is a form of zeolite X.

8. Process of claim 7 where said crystalline aluminosilicate is a form of zeolite Y.

9. The process of claim 4 where said sorbent is a synthetic faujasite.

10. The process of claim 9 where average pore diameter is about 8–9 Å and the average surface area is from about 200–1000 $m^2/g$.

11. The process of claim 9 where the amount of HCl adsorbed is from about 00.1 to 17.5 wt. %.

12. The process of claim 11 where the amount of HCl adsorbed is at least about 0.1 wt. %.

13. The process of claim 5 where the amount of HCl adsorbed is from about 0.1–17.5 wt. %.

14. The process of claim 13 where the amount of HCl adsorbed is at least about 1 wt. %.

15. The process of claim 5 where the average pore diameter is from about 20 to about 100 Å and the average surface area is from about 150 to about 600 $m^2/g$.

16. The process of claim 15 where the sorbent is an amorphous silica/alumina having from about 5 to about 95 wt. % silica.

17. The process of claim 1 where said contaminant is tetra-alkyl-lead.

18. The process of claim 1 where said hydrocarbon media is a reformer feedstock comprised substantially of naphtha.

19. The process of claim 1 where said hydrocarbon media is a motor fuel.

20. The process of claim 19 where said motor fuel is an unleaded gasoline.

21. The process of claim 1 wherein after processing less than 5 parts per billion of said alkyl lead contaminant remain in said hydrocarbon media.

22. A process for effecting the removal of alkyl lead contaminant from liquid hydrocarbon media containing said contaminant which comprises contacting it at a temperature of from about 25°–60° C. and a LHSV of from about 5–20 with a solid sorbent selected from the group consisting of various forms of silica, bauxite, mordenite, natural and synthetic clays, amorphous and crystalline aluminosilicates, alumina and silica-alumina mixtures having a pore diameter of from about 3–200 Å and a surface area of from about 5–1000 $m^2/g$ having adsorbed therein from about 0.001–20 wt. % of anhydrous hydrogen chloride until substantially all of said contaminant is removed therefrom.

23. The process of claim 22 wherein the liquid hydrocarbon media is pre-dried prior to effecting removal of the lead contaminant by first contacting said hydrocarbon media with a suitable drying agent.

24. The process of claim 22 wherein the liquid hydrocarbon media is contacted with a suitable sorbent not having anhydrous hydrogen chloride adsorbed therein after effecting removal of the lead contaminant thereby adsorbing any anhydrous hydrogen chloride desorbed during said removal process.

* * * * *

UNITED STATES PATENT AND TRADEMARK OFFICE

CERTIFICATE OF CORRECTION

PATENT NO. : 4,424,120

DATED : January 3, 1984

INVENTOR(S) : Costandi A. Audeh

It is certified that error appears in the above—identified patent and that said Letters Patent is hereby corrected as shown below:

Column 5, line 23, "0.13" should be —1.13—.

Signed and Sealed this

*Seventeenth* Day of *July 1984*

[SEAL]

*Attest:*

GERALD J. MOSSINGHOFF

*Attesting Officer*

*Commissioner of Patents and Trademarks*